US012133585B2

(12) United States Patent
Hammersen et al.

(10) Patent No.: US 12,133,585 B2
(45) Date of Patent: Nov. 5, 2024

(54) DISPENSER

(71) Applicant: RPC BRAMLAGE GMBH, Lohne (DE)

(72) Inventors: Lea Hammersen, Lohne (DE); Simon Busse, Lohne (DE)

(73) Assignee: RPC BRAMLAGE GMBH, Lohne (DE)

( * ) Notice: Subject to any disclaimer, the term of this patent is extended or adjusted under 35 U.S.C. 154(b) by 243 days.

(21) Appl. No.: 17/642,450

(22) PCT Filed: Sep. 14, 2020

(86) PCT No.: PCT/EP2020/075672
§ 371 (c)(1),
(2) Date: Mar. 11, 2022

(87) PCT Pub. No.: WO2021/048447
PCT Pub. Date: Mar. 18, 2021

(65) Prior Publication Data

US 2022/0304447 A1 Sep. 29, 2022

(30) Foreign Application Priority Data

Sep. 13, 2019 (GB) ..... 1913241
Jun. 26, 2020 (GB) ..... 2009779

(51) Int. Cl.
*A45D 34/04* (2006.01)

(52) U.S. Cl.
CPC ..... *A45D 34/04* (2013.01); *A45D 2200/055* (2013.01)

(58) Field of Classification Search
CPC ..... A45D 2200/054; A45D 2200/055; B01L 3/0282; B65D 1/323; B65D 1/326
USPC ..... 141/22, 24, 31
See application file for complete search history.

(56) References Cited

U.S. PATENT DOCUMENTS

| | | | | |
|---|---|---|---|---|
| 3,379,196 | A * | 4/1968 | Mitchell | B01L 3/0282 222/215 |
| 5,226,572 | A * | 7/1993 | Gargione | G01F 11/084 422/922 |
| 9,546,026 | B2 | 1/2017 | Drugeon | |
| 10,806,232 | B2 | 10/2020 | Jung | |

FOREIGN PATENT DOCUMENTS

| | | |
|---|---|---|
| EP | 2596717 | 5/2013 |
| FR | 2964953 | 3/2012 |
| FR | 3026726 | 4/2016 |
| WO | 2011154397 | 12/2011 |
| WO | 2013178927 | 12/2013 |
| WO | 2014032866 | 3/2014 |
| WO | 2018124434 | 7/2018 |

OTHER PUBLICATIONS

International Search Report and Written Opinion for PCT/EP2020/075672 dated Jan. 22, 2021.

* cited by examiner

*Primary Examiner* — Timothy L Maust
(74) *Attorney, Agent, or Firm* — Barnes & Thornburg LLP

(57) ABSTRACT

A dropper dispenser is provided and comprises a body and a dispensing tube. The body includes two or more parts. One or more of the parts is movable to create a vacuum to draw fluid into the dispensing tube.

14 Claims, 16 Drawing Sheets

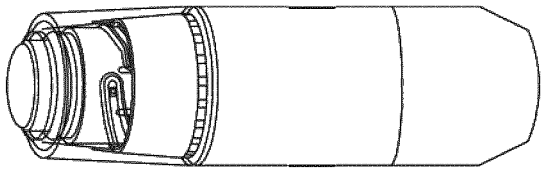
Figure 17
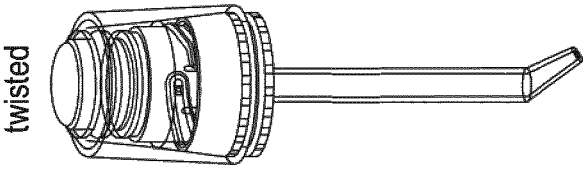
Figure 16
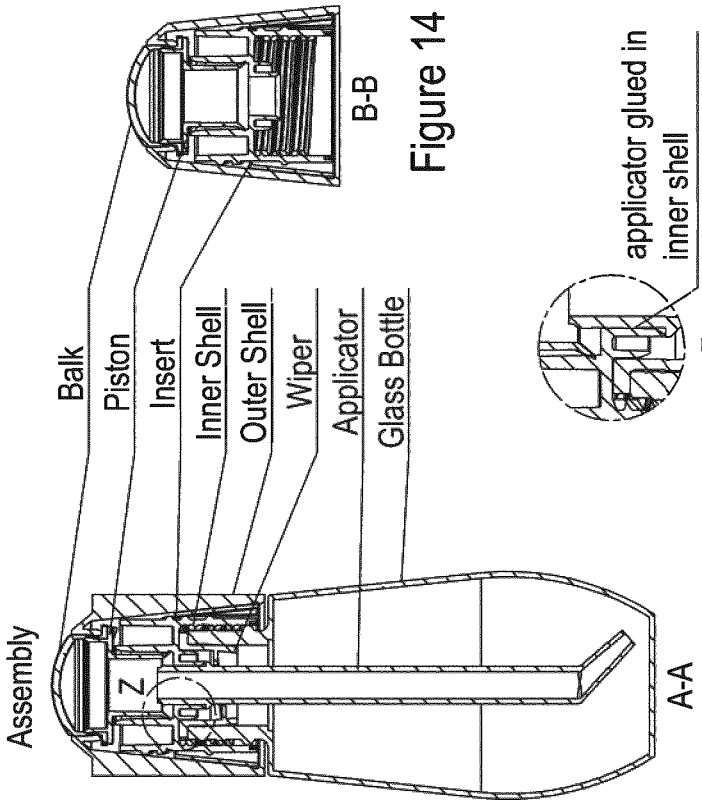
Figure 11
Figure 14
Figure 13
Figure 12
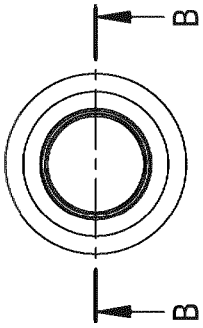
Figure 15

A-A
(5:1)

A-A

Z
(10:1)

Y
(10:1)

DISPENSER

CROSS REFERENCE TO RELATED APPLICATIONS

This application is a U.S. national stage application under 35 U.S.C. § 371(b) of International Application No. PCT/EP2020/075672 filed Sep. 14, 2020, which claims priority to the United Kingdom Patent Application No. 1913241.4 filed on Sep. 13, 2019 and the United Kingdom Patent Application No. 2009779.6 filed on Jun. 26, 2020, the disclosures of each of which are hereby expressly incorporated by reference in their entirety.

The present invention relates generally to a dispenser for flowable product and particularly, although not exclusively, to a dropper for dispensing liquid from a container.

BACKGROUND

Droppers as often constructed to employ an open-ended glass tube formed with a restriction at one end and carrying a rubber bulb at the other which is manipulated to both fill the dropper and to expel the liquid therefrom in the form of drops.

Many fluids are dosed or administered by means of dropper bottles. Dosing in the form of droplets is particularly widespread in the pharmaceutical or para-pharmaceutical field for administering in a precise manner a drug for oral or topical use, for example nasal, ophthalmic or otological use. Dosing in droplets is also very commonly used for dosing aromatic, balsamic or similar products.

SUMMARY

The present invention seeks to provide improvements in or relating to dropper-type dispensers.

According to an aspect of the present invention there is provided a dropper dispenser comprising a body and a dispensing tube, the body including two or more parts, one or more of the parts is movable to create a vacuum to draw fluid into the dispensing tube.

According to an aspect of the present invention there is provided a dropper including two or more parts, one or more of the parts is movable to create a vacuum to draw fluid into a dispensing tube.

According to an aspect of the present invention there is provided a dropper including a pipe into which and out from which fluid can be drawn and expelled, the dropper includes a piston operable to draw and expel fluid in use. In some embodiments, for example movement of parts and/or a reduction in volume is used to expel liquid.

In some embodiments one or more parts is/are movable relative to one or more other parts. For example one part may be movable, whilst another part remains stationary, to cause the drawing of fluid.

In some embodiments the dispenser comprises an outer part and an inner part.

One or more parts of a body may be rotatable and/or translatable relative to one or more other parts.

The inner part may be attached or attachable, for example detachably attachable, to a container.

Outer and inner parts may be directly connectable. In some embodiments, however, an insert part may be provided and may fit between outer and inner parts. The insert may include means for causing/assisting/guiding relative movement between parts (e.g. inner and outer parts/shells).

The outer part may move relative to the inner part to create a vacuum; the inner part may remain stationary at least during a filling phase. Alternatively the inner part may move relative to the outer part to create vacuum; the outer part may remain stationary at least during a filling phase. Alternatively an insert may move whilst inner and outer parts remain stationary, for example. In some embodiments more than one part moves.

In some embodiments the dispenser body is connectable to a container such as a bottle.

In some embodiments the body is not removed/removable from the container until the or each part has moved to create a vacuum. In other words there is a filling phase which is completed before the body can be removed i.e. filling is automatic as part of the removal (e.g. unscrewing) process.

In some embodiments differential friction is used to determine which part/s move and/or the order in which parts move during an opening/dispensing sequence. For example in one embodiment one interaction is formed by a screw threaded interaction whilst another interaction is formed by a cam interaction; the threaded interaction has a higher level of friction than the cam interaction (for example a cam and a slope), meaning that the cam interaction initiates (and may complete) before the threaded interaction can/does initiate.

In some embodiments differential tightness of fit is used to determine an order in which parts of the body can move. For example the fit between parts may be looser than the fit between the body and the container, causing the movement between the parts to occur before removal of the body. Alternatively or additionally opening functionality may be provided by using different types and/or inclination of cooperating engagement means e.g. using inter-engaging surface formations with a lesser inclination to cause a primary motion and formations with a greater inclination to cause a secondary motion.

In some embodiments parts may be directly or indirectly connected by surface formations, for example screw thread formations and/or a cam arrangement, The dispenser may comprise a piston or piston-like structure for drawing fluid into and/or dispensing fluid from the tube.

A button or other pressing means may be provided for dispensing fluid from the tube.

The button may be flexible and could, for example, be formed as a bellows. In other embodiments the button may be rigid.

The present invention also provides a dispenser as described herein in combination with a container.

A further aspect provides a dropper assembly comprising a closure and a bottle, the closure comprises an outer part, an inner part and a dispensing tube, the inner part is releasably attachable to the bottle, in which initial rotation of the outer part causes relative movement between the outer and inner parts and in doing so creates a vacuum to draw liquid into the tube from the bottle, and in which continued rotation of the outer part causes release of the closure from the bottle to allow dispensing of liquid from the tube.

A further aspect provides a dropper assembly comprising a closure and a bottle, the closure comprises an outer part, an inner part, an insert and a dispensing tube, the inner part is releasably attachable to the bottle, in which initial rotation of the outer part causes relative movement of the insert and in doing so creates a vacuum to draw liquid into the tube from the bottle, and in which continued rotation of the outer part causes release of the closure from the bottle to allow dispensing of liquid from the tube.

The inner part may be connected to the bottle using cooperating screw thread formations.

The outer and inner parts may be connected by a cam arrangement. Alternatively or additionally the outer and inner parts may be connected by cooperating screw thread formations.

The outer and inner parts and/or the insert (where provided) may be interconnected connected by a cam arrangement.

The outer and inner parts and/or the insert (where provided) may be interconnected by screw thread formation/s.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

BRIEF DESCRIPTIONS OF THE DRAWINGS

The present invention will now be more particularly described, by way of example, with reference to the accompanying drawings.

Figure 7:
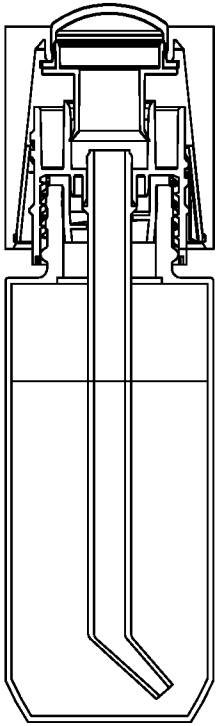
Figure 6:
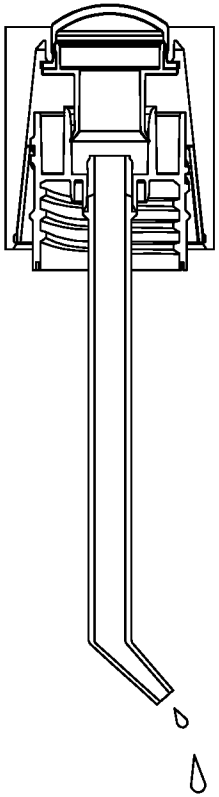
FIG. 6 is a cross section of the dropper dispenser.

FIG. 7 cross section of the dropper dispenser showing an inner shell screwed on the bottle.

Figure 8:
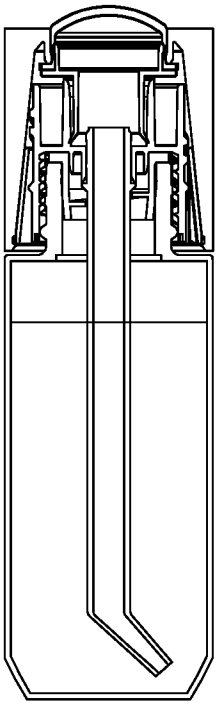

FIG. 8 is a cross section of the dropper dispenser showing an outer shell moved down relative to the bottle.

Figure 9:
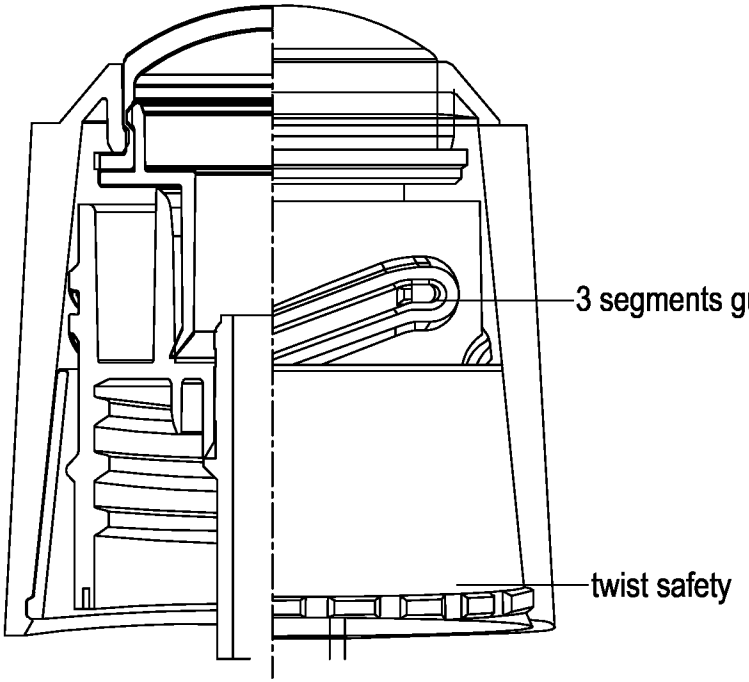

FIG. 9 is a partial cross section of a portion of the dropper dispenser.

Figure 10:
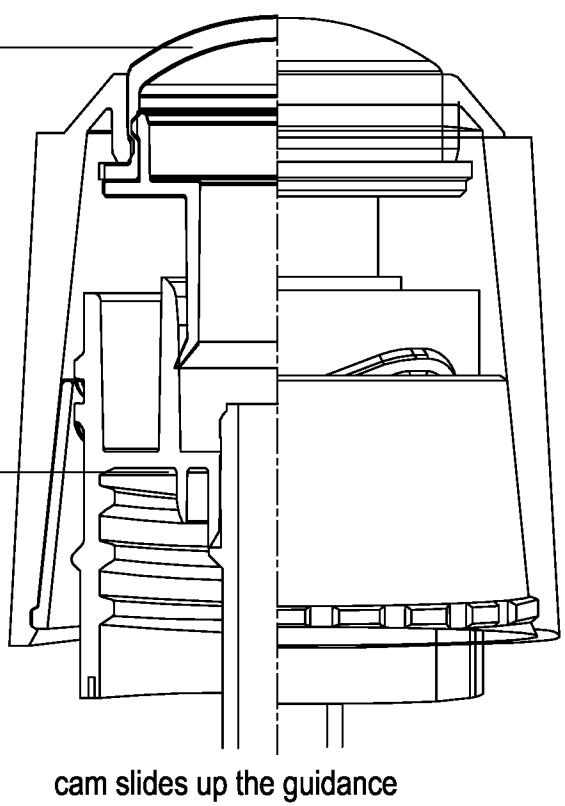

FIG. 10 is a partial cross section of a portion of the dropper dispenser.

FIG. 11 is a cross section of an assembled dispenser taken along line A-A in FIG. 12.

FIG. 12 is a top view of the dispenser.

FIG. 13 is an enlarged view of a portion of FIG. 11.

FIG. 14 is a cross section of a portion of the dispenser taken along line B-B in FIG. 15.

FIG. 15 is a top view of a portion of the dispenser.

FIG. 16 is a perspective view of the dropper dispenser.

FIG. 17 is a perspective view of the dispenser.

Figure 18:
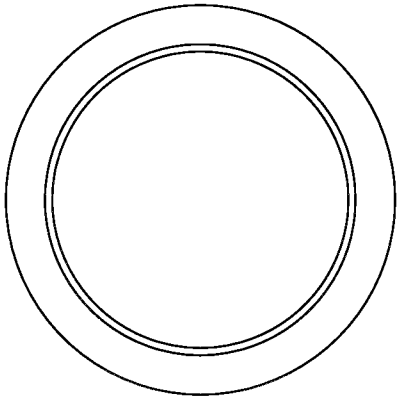

FIG. 18 is a top view of a press button included in the dispenser.

Figure 19:
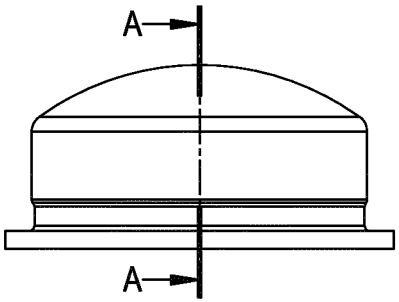

FIG. 19 is a side view of the press button.

Figure 20:
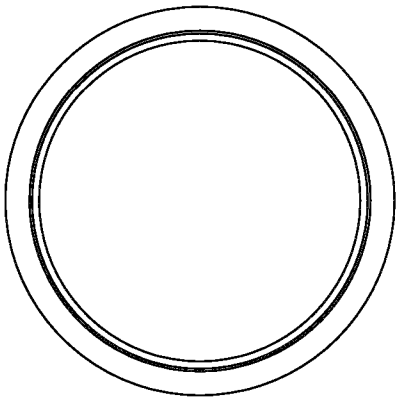

FIG. 20 is a top view of the press button.

Figure 21:
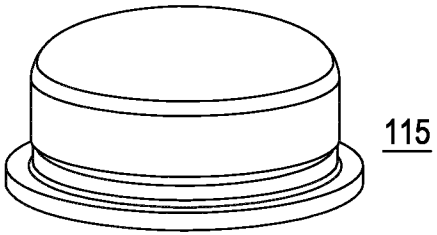

FIG. 21 is a perspective view of the press button.

Figure 22:
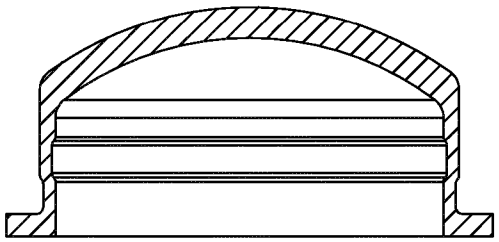

FIG. 22 is a cross section of the press button taken along line A-A in FIG. 19.

Figure 23:
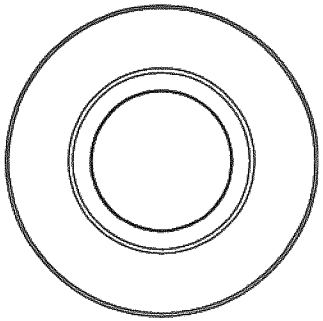

FIG. 23 is a bottom view of a piston included in the dropper dispenser.

Figure 24:
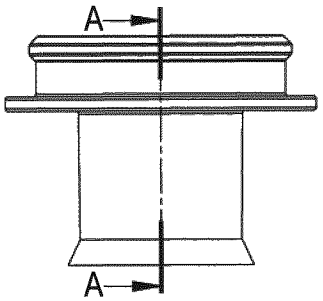

FIG. 24 is a side view of the piston.

Figure 25:
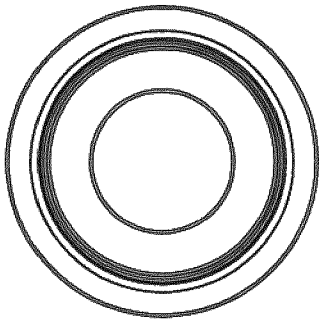

FIG. 25 top view of the piston.

Figure 26:
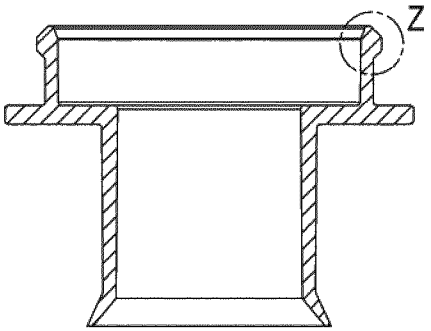

FIG. 26 is a cross section of the piston taken along line A-A in FIG. 24.

Figure 27:
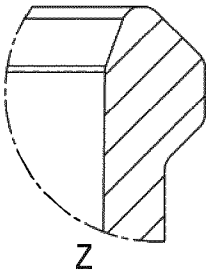

FIG. 27 is an enlarged view of a portion of the piston from FIG. 26.

Figure 28:
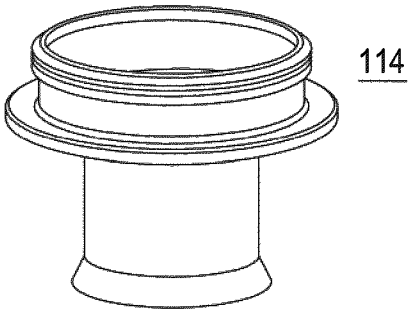

FIG. 28 is a perspective view of the piston.

Figure 29:
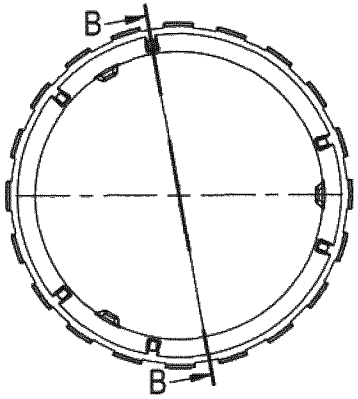

FIG. 29 is a bottom view of an insert included in the dropper dispenser.

Figure 31:
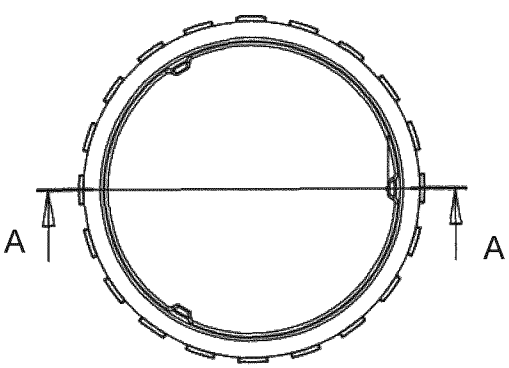
Figure 30:
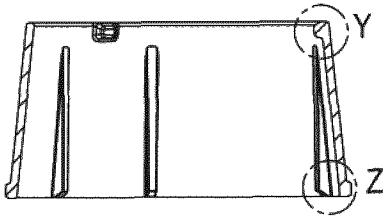

FIG. 30 is a cross section of the insert taken along line A-A in FIG. 31.

FIG. 31 is a top view of the insert.

Figure 32:
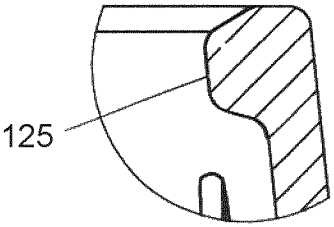

FIG. 32 is an enlarged view of a portion of FIG. 30.

Figure 33:
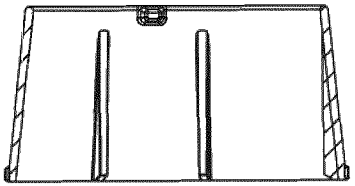

FIG. 33 is a cross section of the insert.

Figure 34:
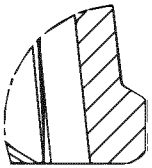

FIG. 34 is an enlarged view of a portion of FIG. 30.

Figure 35:
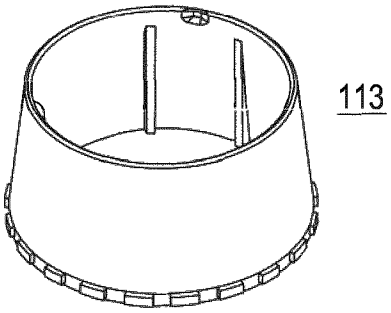

FIG. 35 is a perspective view of the insert.

Figure 36:
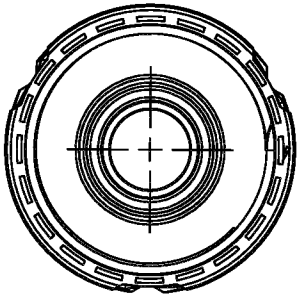

FIG. 36 is a bottom view of the inner shell.

Figure 37:
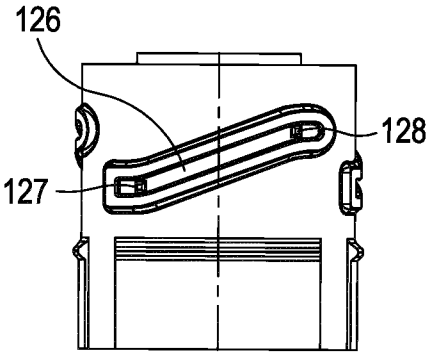

FIG. 37 is a side view of the inner shell.

Figure 38:
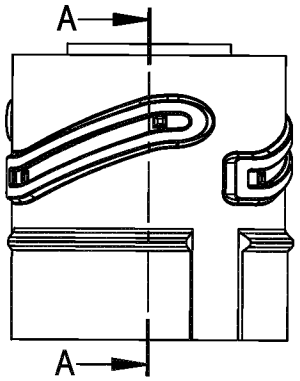

FIG. 38 is a side view of the inner shell.

Figure 39:
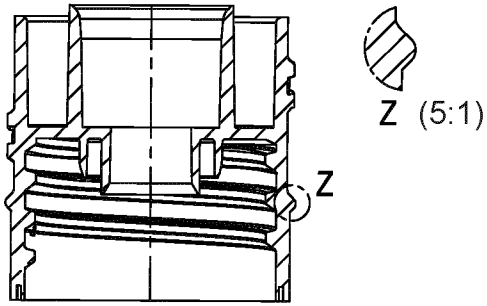

FIG. 39 is a cross section of the inner shell taken along line A-A in FIG. 38.

Figure 40:
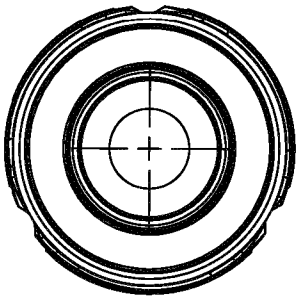

FIG. 40 is a top view of the inner shell.

Figure 41:
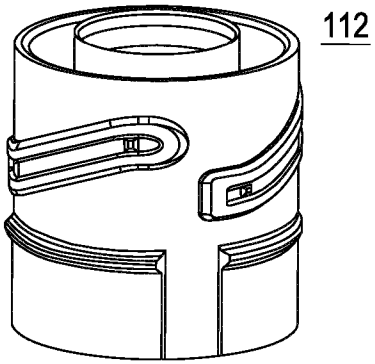

FIG. 41 is a perspective view of the inner shell.

Figure 42:
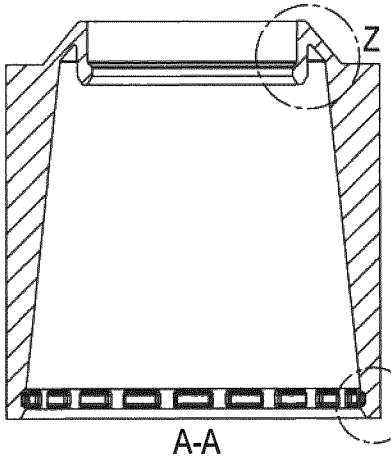
Figure 43:
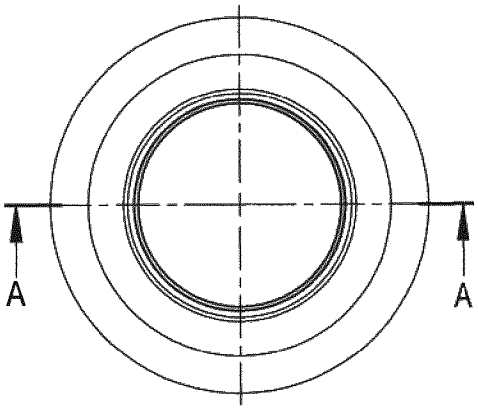

FIG. 42 is a cross section of the outer shell taken along line A-A in FIG. 43.

FIG. 43 is a top view of the outer shell.

Figure 44:
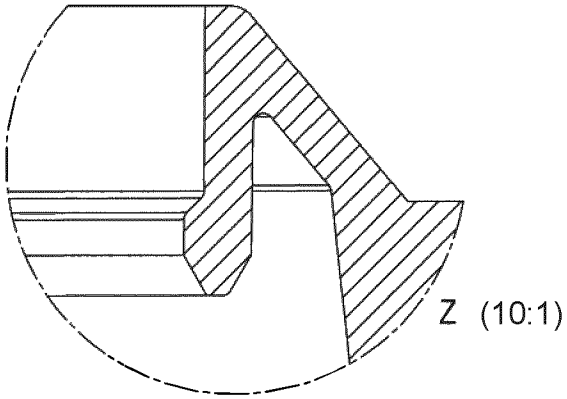

FIG. 44 is an enlarged view of a portion of FIG. 42.

Figure 45:
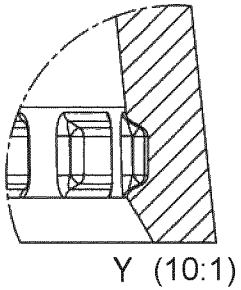

FIG. 45 is an enlarged view of a portion of FIG. 42.

Figure 46:
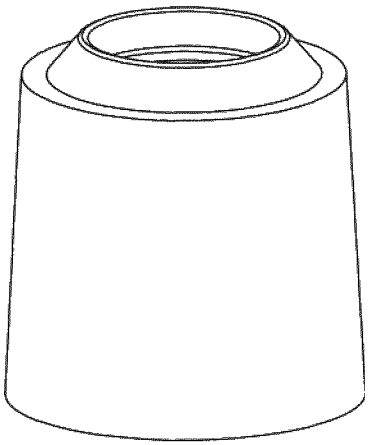

FIG. 46 is a perspective view of the outer shell.

Figure 47:
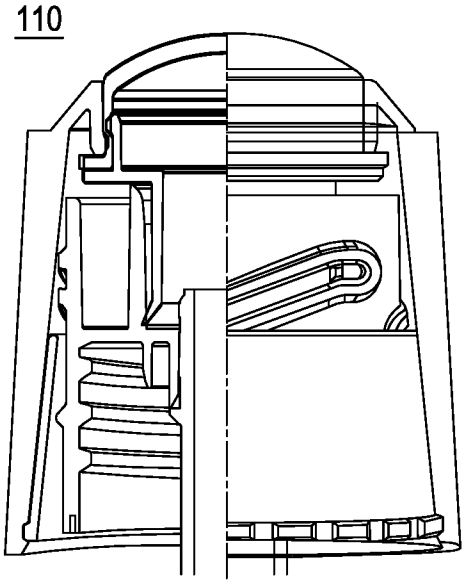

FIG. 47 is a partial cross section of another embodiment of a dropper.

Figure 48:
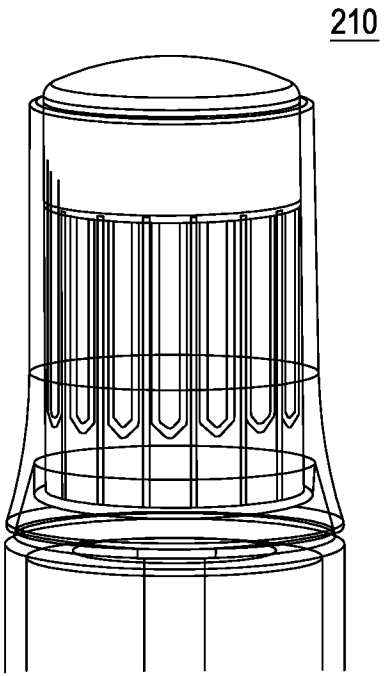

FIG. 48 is a perspective view of another embodiment of a dispenser.

Figure 49:
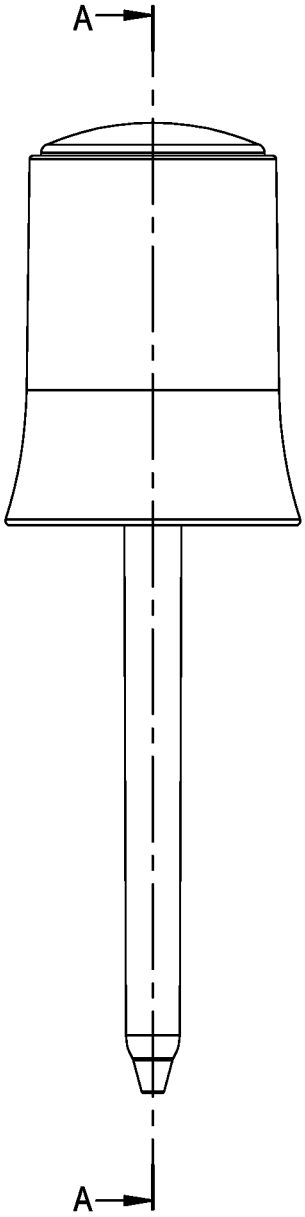

FIG. 49 is a side view of the dispenser of FIG. 48.

Figure 50:
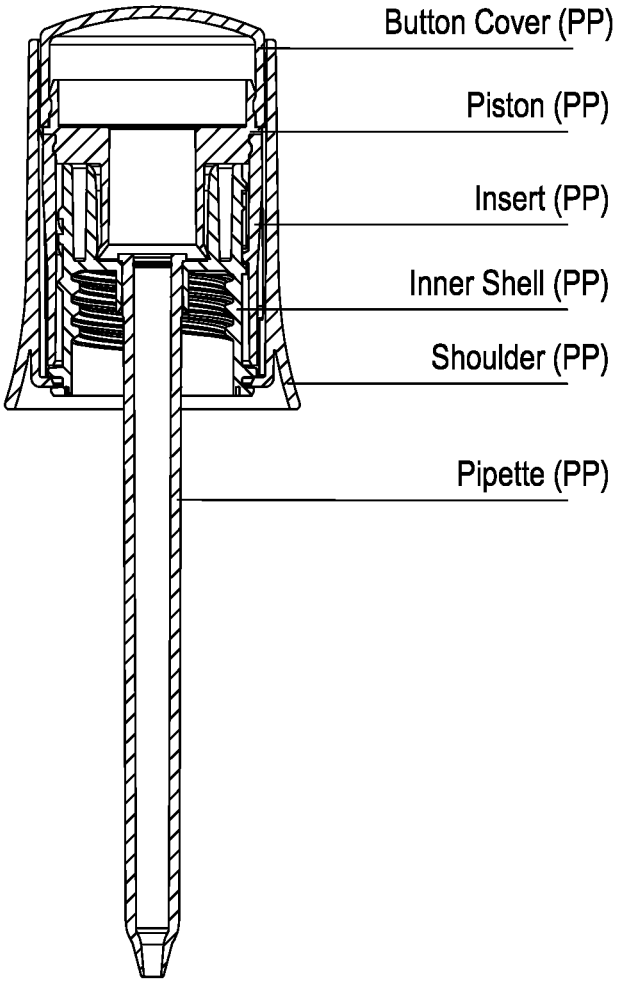

FIG. 50 is a cross section of the dispenser of FIG. 48.

Figure 51:
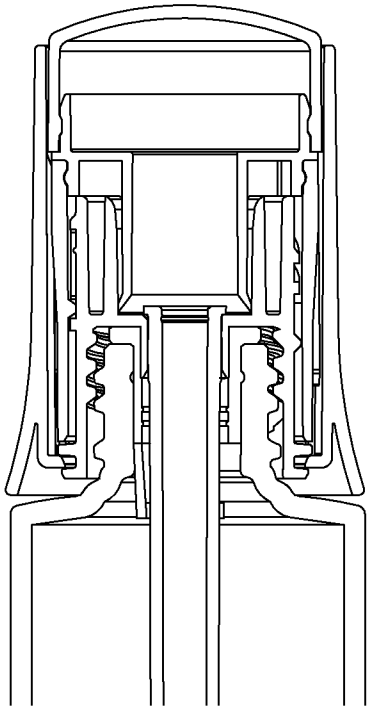

FIG. 51 is a cross section of the dispenser of FIG. 48 screwed on a bottle.

Figure 52:
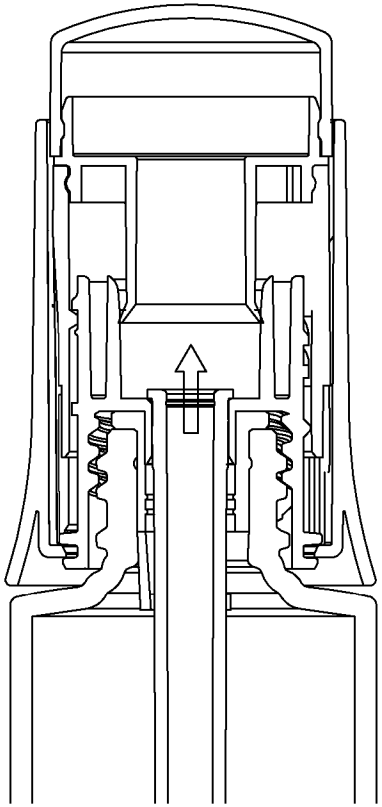

FIG. 52 is a cross section of the dispenser of FIG. 48 with an outer shell screwed up.

Figure 53:
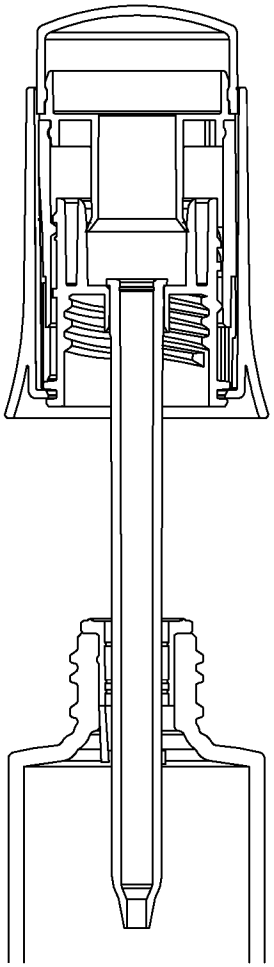

FIG. 53 is a cross section of the dispenser of FIG. 48 partially separated from the bottle.

Figure 54:
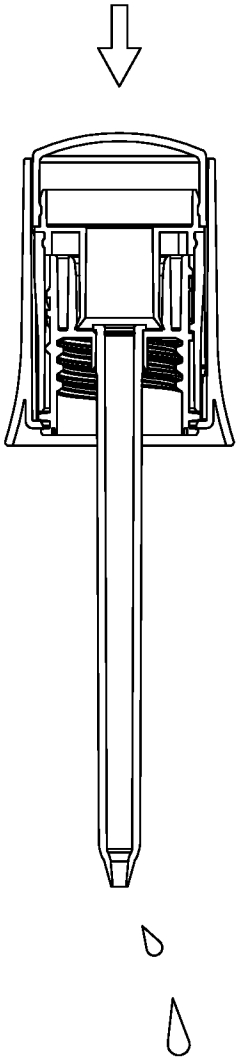

FIG. 54 is a cross section of the dispenser of FIG. 48 with a button pressed.

Figure 55:
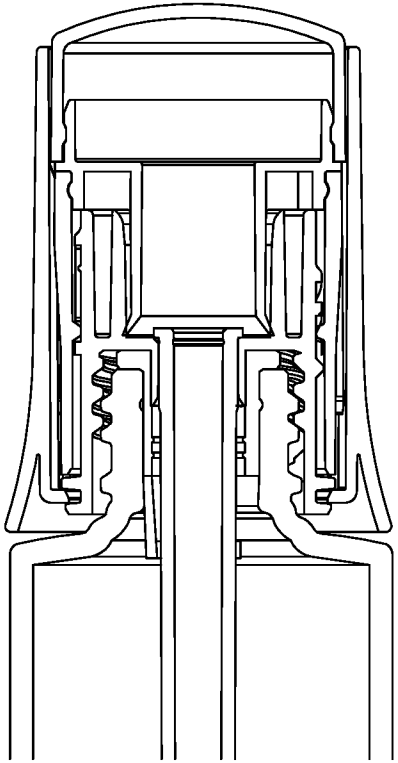

FIG. 55 is a cross section of the dispenser of FIG. 48 installed on the bottle.

Figure 56:
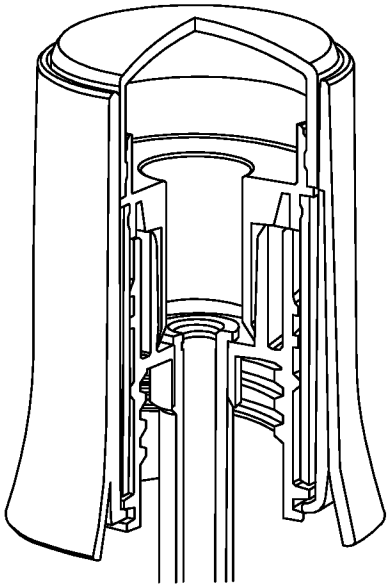

FIG. 56 is a perspective view of the dispenser of FIG. 48 with a section removed.

Figure 57:
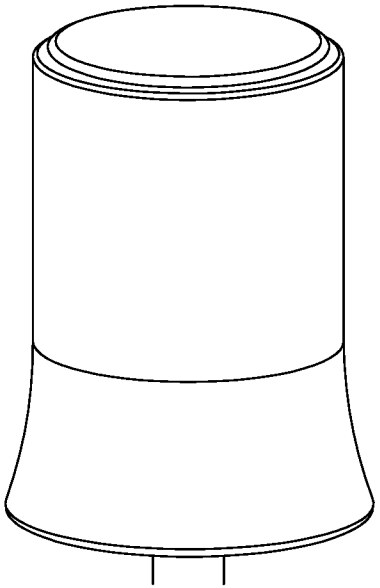

FIG. 57 is a perspective view of the dispenser of FIG. 48 with the button pressed.

Figure 58:
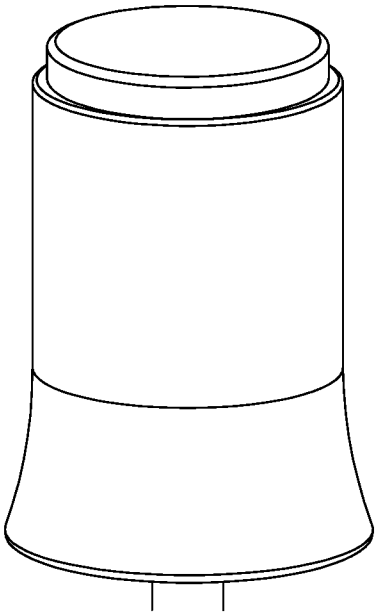

FIG. 58 is a perspective view of the dispenser of FIG. 48 with the button raised.

Figure 59:
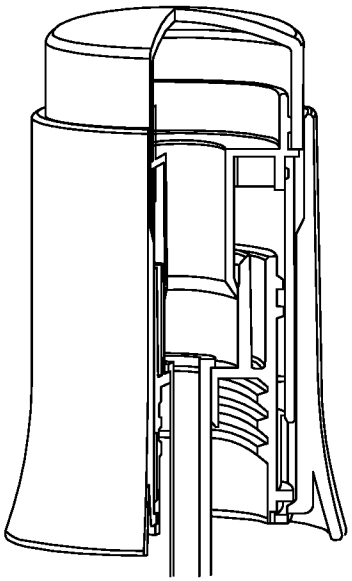

FIG. 59 is a perspective view of the dispenser of FIG. 48 with a section removed.

Figure 60:
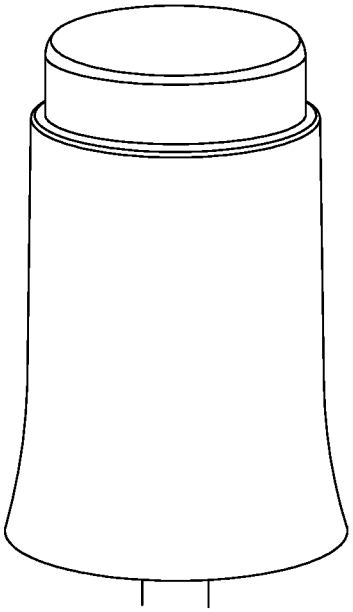

FIG. 60 is a perspective view of the dispenser of FIG. 48 with the button raised.

Figure 61:
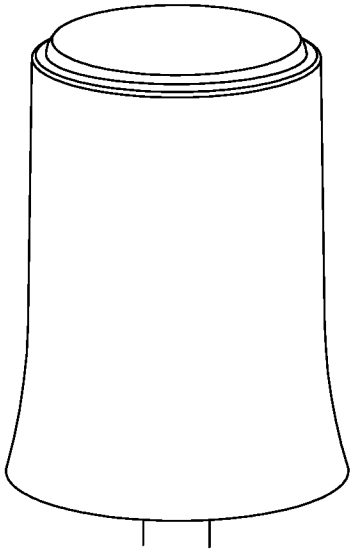

FIG. 61 is a perspective view of the dispenser of FIG. 48 with the button pressed.

DETAILED DESCRIPTION

Example embodiments are shown and described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate. The invention is not limited in the design and shape of the structure shown in the drawings.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring first to FIGS. 1 to 8 there is shown a dropper dispenser generally indicated 10 and a bottle generally indicated 20.

The dispenser 10 comprises an outer shell 11, an inner shell 12, an insert 13, a piston 14, a press-button 15 (in this embodiment being resilient/flexible) and a tube/pipette 16.

The bottle 30 comprises an open end defined by a neck 32 having an external screw thread 33.

The outer shell 11 is generally frusto-conical. The insert 13 fits/snaps into one end of the outer shell 11. The insert 13 includes a cooperating surface formation to engage the external screw thread formation on the inner shell.

At the other end of the outer shell lithe flexible press button 15 snaps/fits in. The piston 14 also snaps/fits into the end of the outer shell, under the button 15.

The inner shell 12 also fits into the outer shell 11. The inner shell 12 comprises an external screw thread formation 17. The inner shell 12 also comprises an inner transverse wall 18 with a central aperture through which one end of the tube 16 extends. Upstanding from the wall around the central aperture is a piston wall 19 within which the piston 14 is slidable (in an air tight fit). Below the wall 18 the inner shell comprises an internal screw thread.

Operation of the dispenser 10 is as follows.

Figure 3:
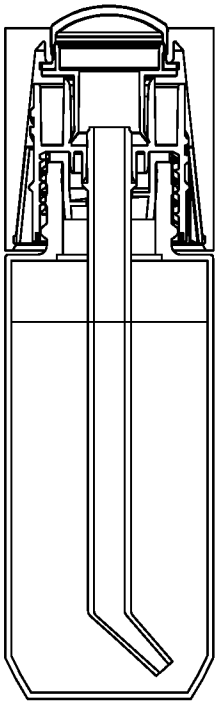
FIG. 3 is a cross section of the dropper dispenser installed on the bottle.

In FIG. 3 the dispenser 10 is shown fitted onto the bottle 30. The inner shell 12 is screwed onto the bottle neck 32 by virtue of the cooperating screw threads 20, 33.

Figure 4:
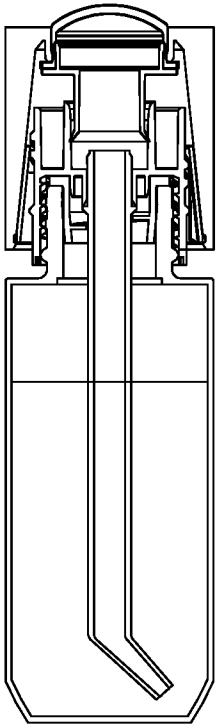
FIG. 4 is a cross section of the dropper dispenser partially installed on the bottle.

The outer shell is rotated and, by virtue of the interaction between the insert and the inner shell, the outer shell screws up to the position shown in FIG. 4. It is noted that the inner shell remains stationary during this phase because the friction between the inner shell and the bottle neck is higher than the interaction between the insert and the inner shell i.e. the outer shell moves first in the opening sequence.

Raising of the outer shell causes lifting of the piston. This means that the piston is pulled through the inner shell piston wall, which creates a vacuum that draws fluid from the bottle up into the tube.

Figure 2:
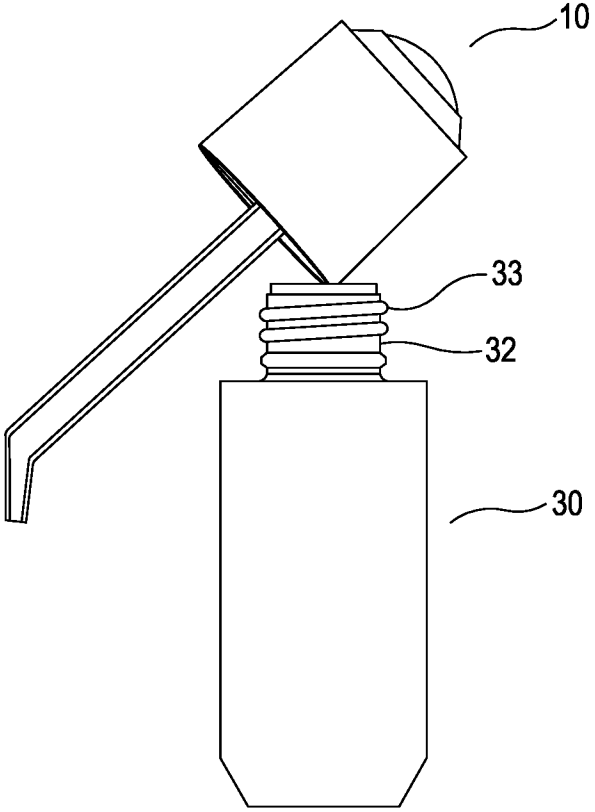
FIG. 2 is a side view of the dropper dispenser and a bottle configured to couple to the dropper dispenser.
Figure 1:
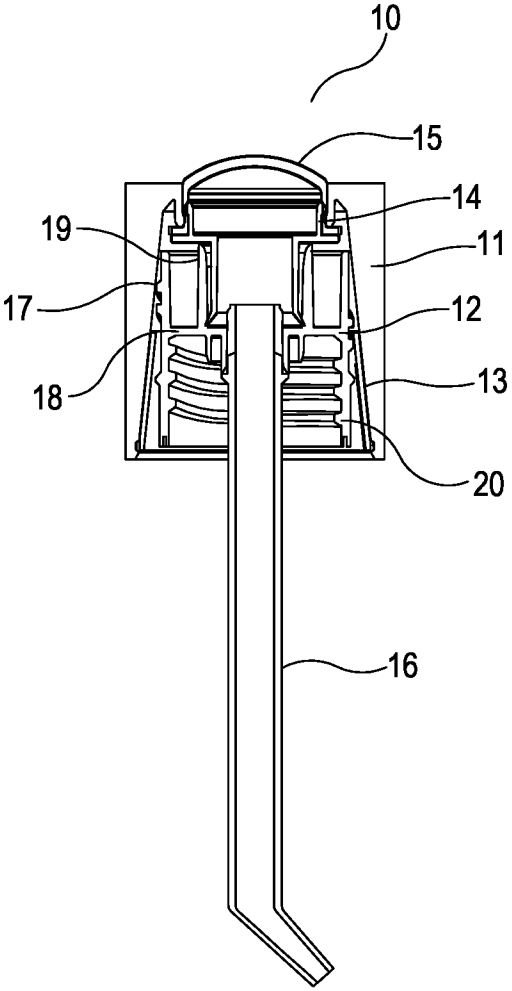
FIG. 1 is a cross section of a dropper dispenser.
Figure 5:
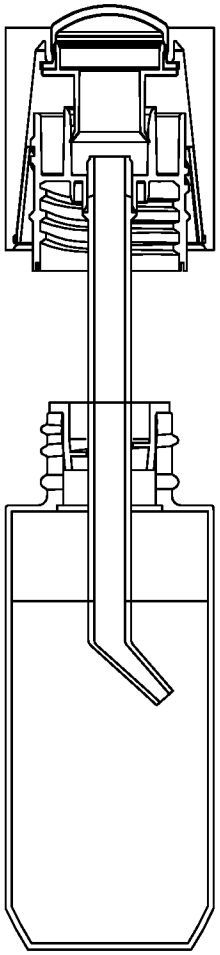
FIG. 5 is a cross section of the dropper dispenser uninstalled from the bottle.

With the outer shell in an end position (FIG. 4) continued rotation/twisting of the outer shell now causes the inner shell to be rotated off the bottle neck (FIG. 5).

The dispenser can now be used to dispense liquid from the tube by depressing the button (FIG. 6); the button therefore functions in the manner of a bellows or the like.

In this embodiment closing of the dispenser is the reverse of opening i.e. first the inner shell screws back down onto the bottle neck (FIG. 7) and thereafter the outer shell moves back down (FIG. 8).

Operation of the dispenser could be summarised as: 1. screw up the outer cap; 2. screw up the inner cap; 3. dispense content; and 4. screw on the inner cap.

FIGS. 9 to 46 illustrate a dispenser 110 and bottle 130 formed according to a further embodiment.

FIGS. 9 and 10 illustrate the general mechanism of the dispenser. The inner shell is provided with a guide channel (in this embodiment having three segments) having travel end stops and the insert is provided with a cam that can slide within the channel.

FIGS. 11 to 17 show the assembled dispenser. FIG. 16 shows the outer shell in a twisted, end position and FIG. 17 shows the outer shell turned back down to a starting position.

FIGS. 18 to 22 show the press-button 115.

FIGS. 23 to 28 show the piston 114.

FIGS. 29 to 35 show the insert 113 (formed as a generally frusto-conical skirt open at both ends) with its cams 125.

FIGS. 36 to 41 show the inner shell 112 with its guidance channels 126 and end stops 127, 128.

FIGS. 42 to 46 show the outer shell 111.

Operation of the dispenser 110 is generally as follows.

1. screw up the dropper
   i. the outer cap is screwed up (cam slides up the guidance)
   ii. this create a vacuum and the content is sucked
   iii. the cam hits the stop of the guidance and the inner cap is screwed from the bottle
2. dispense content
   i. content is dispensed by deforming the button, which reduces the volume in the piston/upper chamber so as to push liquid out of the pipe
3. screw on the dropper
   i. the outer cap is screwed down (cam slides down the guidance)
   ii. the cam hit the stop of the guidance and the inner cap is screwed on the bottle In this embodiment, therefore rotation of the outer shell causes is to rise up the inner shell (caused by the action of the insert).

FIG. 47 shows the of FIGS. 9 to 46 next to a dropper 210 formed according to a further embodiment—FIGS. 48 to 50.

General differences of the dispenser of FIG. 48 compared to the dispenser of FIG. 47:

Outer Shell remains the same height while screwing

Insert slides upwards along Outer shell

Button (hard component), Piston and Insert are moving up

Dispensing by pushing down the Button into starting position; the Button is connected to the Piston so movement of the Button reduces the volume below the piston to push liquid out of the pipe/tube All around guidance (easier assembling)

Operation of the dispenser is illustrated in FIGS. 51 to 61 and is generally as follows.

A section of the dispenser 210 shown in a closed position is shown in FIG. 51.

1. Screw up the dropper—FIG. 52 i. the Outer Shell is turned; torque is transferred with ribs to Insert (cams on the insert slide up the guidance on the Inner Shell)

ii. Insert, Piston and Button move upwards, this creates a vacuum and the content is sucked iii. the cam hit the stop of the guidance and the inner cap is screwed from the bottle—FIG. 53

2. Dispense content—FIG. 54 i. content is dispense by pressing down the Button ii. Cams will slide down the guidance into starting position 3. Screw on the dropper—FIG. 55 i. the outer cap is screwed down (cam transfers torque to the thread)

ii. After thread to the bottle is closed, the inner cap/shall/part is back in its starting position Operation of the dispenser could also be described as:

Screw outer cap. The insert will slide along the outer shell upwards. The outer shell stays at the same height. The piston and button will go up with the insert to create a vacuum. The content is pulled up. Screw up the inner cap. Dispense content by pushing down the button and the piston. Screw on the inner cap.

FIG. 56 is a partial section showing the dispenser 210 in a closed position. FIG. 57 shows the dispenser of FIG. 56 with the outer cap shown in phantom to illustrate the opening mechanism, with the insert cam shown engaged in the inner cap guide channel and positioned against the first end stop. In FIG. 58 the outer cap starts to be turned and this causes the insert (plus the position and the button) to rise up; the cam can be seen having travelled along the guide channel and in FIG. 58 the came is shown roughly intermediate the channel end stops.

In FIGS. 59 and 60 the full extent of insert lift has occurred and the cam can be seen against the other channel end stop. The dispenser can now be rotated off the bottle.

FIG. 61 shows the dispenser back in a rest position.

In this embodiment, therefore, the inner and outer shells do not move relative to each other, but relative rotation between the inner and outer shells causes movement of the intermediate insert.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A dropper dispenser comprising a body and a dispensing tube, the body connectable to a container and including two or more parts, one or more of the parts is movable relative to one or more other parts to create a vacuum to draw fluid into the dispensing tube, the dropper dispenser comprising a piston or piston-like structure for drawing fluid into and or dispensing fluid from the dispensing tube and further comprising a button for dispensing fluid from the dispensing tube;

the two or more parts of the body comprising an outer part and an inner part, the inner part comprising an inner transverse wall with a central aperture through which one end of the dispensing tube extends and, upstanding from the wall around the central aperture, a piston wall within which the piston or piston-like structure is slidable in an air tight fit;

the piston or piston-like structure fitted within the body to be:

lifted within the inner part as the outer part is moved relative to the inner part to remove the body from the container, the lifting of the piston or piston-like structure creating a vacuum to draw fluid into the dispensing tube during a filling phase which is completed before the body is removed from the container, and lowered within the inner part as the button is pushed following removal of the body from the container, to dispense fluid from the dispensing tube.

2. A dropper dispenser as claimed in claim 1, in which one or more parts is rotatable and/or translatable relative to one or more other parts.

3. A dropper dispenser as claimed in claim 1, in which the inner part is attachable to a container.

4. A dropper dispenser as claimed in claim 1, in which the outer part moves upwards relative to the inner part to cause lifting of the piston or piston-like structure to create a vacuum to draw fluid into the dispensing tube.

5. A dropper dispenser as claimed in claim 1, comprising an insert part.

6. A dispenser as claimed in claim 5, in which the insert part moves relative to the outer part and/or the inner part during removal of the body from the container.

7. A dropper dispenser as claimed in claim 5, in which the insert part drives and/or causes and/or guides movement of the outer part and/or the inner part.

8. A dropper dispenser as claimed in claim 5, in which the insert part moves to cause fluid to be drawn into the dispensing tube during the filling phase.

9. A dropper dispenser as claimed in claim 1, in which differential friction is used to determine the order in which two or more parts of the body can move.

10. A dropper dispenser as claimed in claim 1, in which the two or more parts of the body are connected by surface formations, a screw thread formation, or a cam arrangement.

11. A dropper dispenser as claimed in claim 1, in which the button is flexible.

12. A dropper dispenser as claimed in claim 1, in which the button is formed as a bellows.

13. A dropper dispenser as claimed in claim 1, in which the button is rigid.

14. A dropper assembly comprising the dispensing dropper of claim 1 and a bottle, in which initial rotation of the outer part causes lifting of the piston or piston-like structure to create a vacuum to draw liquid into the dispensing tube from the bottle, and in which continued rotation of the outer part causes release of the body from the bottle to allow dispensing of liquid from the dispensing tube.

* * * * *